US006625907B2

(12) United States Patent
Murray et al.

(10) Patent No.: US 6,625,907 B2
(45) Date of Patent: Sep. 30, 2003

(54) METHOD AND APPARATUS FOR DREDGING AND TRANSPORTING DREDGED SOLIDS

(75) Inventors: Richard R. Murray, Pearsall, TX (US); Steven E. Jones, Houston, TX (US)

(73) Assignee: Conveyance Technology, Pearsall, TX (US)

( * ) Notice: Subject to any disclaimer, the term of this patent is extended or adjusted under 35 U.S.C. 154(b) by 0 days.

(21) Appl. No.: 09/897,293

(22) Filed: Jun. 29, 2001

(65) Prior Publication Data

US 2002/0059740 A1 May 23, 2002

Related U.S. Application Data

(60) Provisional application No. 60/214,908, filed on Jun. 29, 2000.

(51) Int. Cl.[7] ..... E02F 3/88
(52) U.S. Cl. ..... 37/332
(58) Field of Search ..... 37/307, 312, 317, 37/320, 322, 323, 341–345, 340, 326–338; 440/36

(56) References Cited

U.S. PATENT DOCUMENTS

| | | | | | |
|---|---|---|---|---|---|
| 3,841,710 | A | * | 10/1974 | Boland et al. | 137/13 |
| 4,023,518 | A | * | 5/1977 | Fahrner | 114/244 |
| 4,680,879 | A | * | 7/1987 | Hill et al. | 277/379 |
| 4,887,371 | A | * | 12/1989 | Kaiser | 37/189 |
| 5,428,908 | A | * | 7/1995 | Kerfoot | 37/318 |
| 5,791,074 | A | * | 8/1998 | Pryor | 37/312 |

* cited by examiner

*Primary Examiner*—Robert E. Pezzuto
(74) *Attorney, Agent, or Firm*—Winstead Sechrest & Minick P.C.; Hugh R. Kress; Henry L. Ehrlich

(57) ABSTRACT

A system and method of the type for quickly mobilizing a unit for dredging a layer of material from a water bottom is provided. The dredging system includes: a motorized, substantially self-contained vessel positioned above a borrow site, at least one dredging shoe extended from the vessel to a bottom of a water adapted for dredging a material from the bottom to a pre-selected depth, a power source positioned on the vessel in operational connection with the dredging shoe for drawing the material into the shoe and transporting the material through a conduit to a deposit site, and a dredging motivation system connected to the vessel for moving the vessel and the dredging shoe along a dredging path.

53 Claims, 5 Drawing Sheets

METHOD AND APPARATUS FOR DREDGING AND TRANSPORTING DREDGED SOLIDS

RELATED APPLICATIONS

This application is a non-provisional application claiming priority to provisional U.S. application number Ser. No. 60/214,908 filed on Jun. 29, 2000.

FIELD OF THE INVENTION

The present invention relates generally to the field of dredging, and more particularly to a dredging system and method of dredging material to a selected depth and depositing the material at an adjacent location such as a beach.

BACKGROUND OF THE INVENTION

Erosion of beaches is a serious problem and is being addressed by every coastal state in the United States and in coastal areas across the world. For example, the state of Texas currently has a fund of $15,000,000 to renourish or reclaim beaches. Florida has a $100,000,000 annual budget for reclaiming beaches. While these budgets might seem excessive, they are necessary under the current technology to renourish eroded beaches. Currently, it is common to renourish a beach once every ten years or so. In reality, the current process consists of remediating the beach after it has eroded which requires the deposit of much greater volumes of beach quality sand, thus requiring the searching for, and locating of the large sand deposits necessary for dredging at great expense.

To renourish beaches, it is necessary to locate and obtain beach quality sand and deposit it in the desired location. Typically, a sufficient deposit of beach quality sand is found in the gulfs, bays, channels and oceans and is dredged. With the conventional manner of dredging it is required to locate large sand deposits (borrow sites). It is becoming more difficult to locate sufficient sand deposits for conventional dredging methods and systems. Additionally, these borrow sites are being located farther from shore than in the past increasing the expense of the operation.

The dredging of the bottoms of bodies of water usually takes one of two forms, suction dredging or shovel dredging. These conventional methods of dredging are not economically efficient for dredging sand for beach reclamation or nourishment.

In suction dredging operations, a typical system consists of a barge floating upon the water surface and the inlet of a pump suction system positioned below the barge permitting the pumping, and removal, of a slurry formed by the bottom materials and water. A power-driven cutterhead is typically utilized proximate the suction conduit inlet to cut and loosen the bottom material and conveying the loosened material toward the suction conduit. The material is then typically pumped through a conduit to the barge, an adjacent vessel or to a remote site.

Prior art suction dredging operations are inefficient and expensive when utilized for beach reclamation. Typically, the dredging system must be transported to a remote location where a substantial depth of a sand deposit is located. It is not uncommon for fees in the range of $500,000 to $1,000,000 to be charged just for the system to be mobilized and moved to a borrow sight having a large sand deposit. As the sand is dredged it is often necessary to transport the sand via a pipeline several miles to a site for clean up and transfer to trucks for transport to the beach or other desired site for deposit. These remote borrow sites commonly require several vessels for operation, expensive booster pumps to transport the dredged material to a site, and additional vessels carrying pipe for forming a conduit from the remote site to a deposit site. The equipment and logistics of these operations undesirably limit the process to being utilized only when necessary and not as a method of maintaining a beach.

In shovel dredging systems, buckets are manipulated away from or toward an operator to scoop the bottom material into the bucket. The bucket is then raised above the water level and deposited in an adjacent vessel or ashore. Again, this method requires a large deposit of sand having a substantial thickness for the operation to be effective. Shovel dredging also requires the use of several vessels and excessive expenses for transporting the dredged material from the borrow site to a deposit site. Additionally, shovel dredging is inefficient for dredging beach quality sand due to the tendency of the dredged sand to wash from the shovel. It is thus desired to provide a dredging system that is substantially self-contained for dredging material proximate a deposit site. It is a further benefit to provide a dredging system adapted for dredging a bottom material that may have a narrow depth. It is a still further benefit to provide a dredging system that leaves a borrow site substantially environmentally intact, minimizes the effect on the marine life and allows quick, natural repair of the borrow site. It is an additional benefit to provide a dredging system and method provides an economical means of maintaining a deposit site as opposed to remediating or reforming a deposit site.

SUMMARY OF THE INVENTION

It is thus one feature of the present invention to provide a substantially self-contained dredging and transport system for mobility reducing the cost of the dredging and deposit operation.

It is a further feature of the present invention to provide a dredging system capable of obtaining quality material for dredging proximate a deposit site.

It is a still further feature of the present invention to provide a dredging system that reduces the detrimental effects on marine life at the borrow site.

It is a still further feature of the present invention allows for relatively quick and natural repair of the borrow site.

Accordingly, a system and method of the type for quickly mobilizing a unit for dredging a layer of material from a water bottom is provided. The dredging system includes: a motorized, substantially self-contained vessel positioned above a borrow site, at least one dredging shoe extended from the vessel to a bottom of a water adapted for dredging a material from said bottom to a pre-selected depth, a power source positioned on the vessel in operational connection with the dredging shoe for drawing the material into the shoe and transporting the material through a conduit to a deposit site, and a dredging motivation system connected to the vessel for moving the vessel and the dredging shoe along a dredging path.

It is desirable to employ a vessel, such as a barge, capable of containing substantially all of the elements of the system for quick deployment. For example, the barge having a sufficient quantity of conduit to be connected or unspooled to connect the dredge shoes to the power supply and form a transport line to the deposit site.

One of the benefits of the system is the ability to dredge material which may not be have a thick enough layer for dredging utilizing prior art methods. For example, beach quality sand is often located within several thousand feet of a shoreline, but often is in a layer of approximately six inches. The current system desirably uses a wheel arrangement and tongue to "scoop" a thin layer of material into the shoe. The material is then suctioned by a dredge pump and transported to the beach via the transport conduit. An additional benefit of taking a thin layer of material is the reduction of stirring up mud and silt at the dredging site, thereby reducing the environmental impact of the operation.

The vessel may be navigated along a precise path through the dredging site utilizing a novel motivation system. The system desirably includes a four-point anchor system. An anchor connected by cable is extended from each corner of the vessel and anchored outside of the area to be dredged. Each cable is connected to a winch so that extending and retracting various cables moves the vessel along a selected path. A global positioning system may be controllably connected to the winches to navigate the vessel along the selected path. This method of moving the vessel adapts the system for operations in rough seas. The motivation may include separate motor systems or a motor system in connection with the four-point anchor system.

The dredge shoes may be utilized singularly or in varying combinations. For example, two or more dredge shoes may be connected directly together to create a greater dredge path. Several dredge shoes may be connected with spacing devices, such as bars, to leave on dredged areas between the dredge paths. This manner of dredging reduces the impact on marine life in the area and facilitates quicker recovery of the borrow site and the marine life. The foregoing has outlined rather broadly the features and technical advantages of the present invention in order that the detailed description of the invention that follows may be better understood. Additional features and advantages of the invention will be described hereinafter which form the subject of the claims appended hereto.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION OF A SPECIFIC EMBODIMENT OF THE INVENTION

Figure 1:
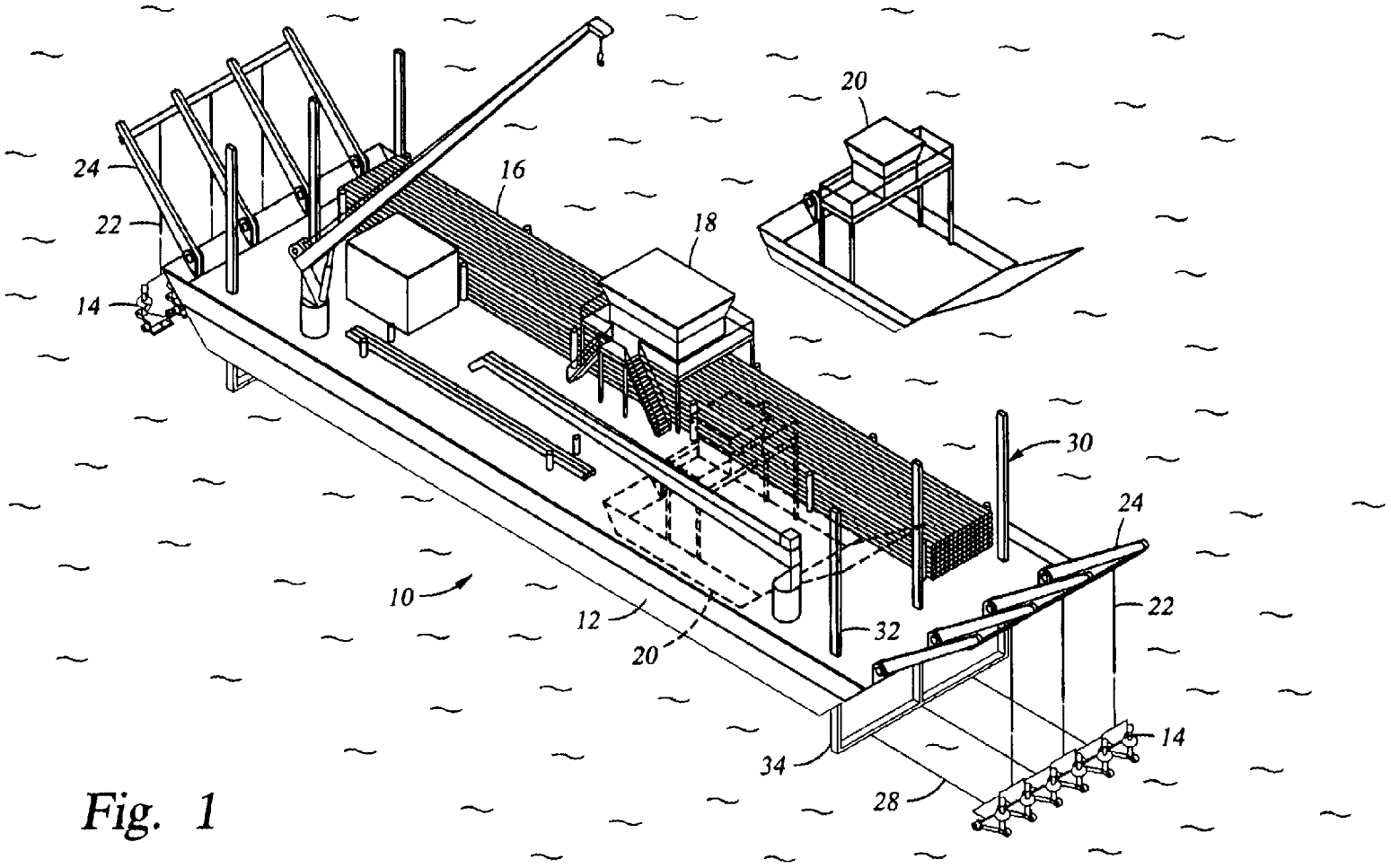
FIG. 1 is a representative view of the dredging system of the present invention.

Refer now to the drawings wherein depicted elements are not necessarily shown to scale and wherein like or similar elements are designated by the same reference numeral through the several Figures.

FIG. 1 is a representative view of the dredging system of the present invention generally denoted by the numeral 10. Dredging system 10 includes a vessel 12, a plurality of dredge shoes 14, a quantity connectable conduit 16 and a power source 18.

Vessel 12 may be a barge or other suitable vessel capable of withstanding sea conditions and adapted for carrying a quantity of equipment, such as hydraulic pumps, electrical motors, electric generators, conduit 16, moving equipment, and operating personnel. Vessel 12 includes a moving element (not shown) such as inboard motors to permit the movement of vessel 12 without the aide of additional vessels. An example of vessel 12 is a one-hundred-eighty feet by fifty-four feet by ten feet barge, having four engines.

Conduit 16 may include various types and diameters of connectable pipe sections, such as but not limited to rubber conduit, plastic conduit and metal pipes. Due to expense considerations, weight concerns, flexibility of conduit lengths and the corrosive nature of the environment, it is often desired to utilize non-metallic conduit. Conduit 16 is connectable in lengths between dredge shoes 14 and power source 18. A length of conduit 16 is also connected to form a transport section 17 (FIG. 2) to move dredged material from shoes 14 to a deposit site, such as a beach. Although not shown in detail, transport section 17 may be designed to float in the water and/or be submerged in the water. Construction of transport conduit section 17 is well known in the art and will be more fully described below.

A work vessel 20 may also be required to aid in constructing the transport section of conduit 16. It may be desired to store work vessel 20 on vessel 18 when not in use.

Figure 2:
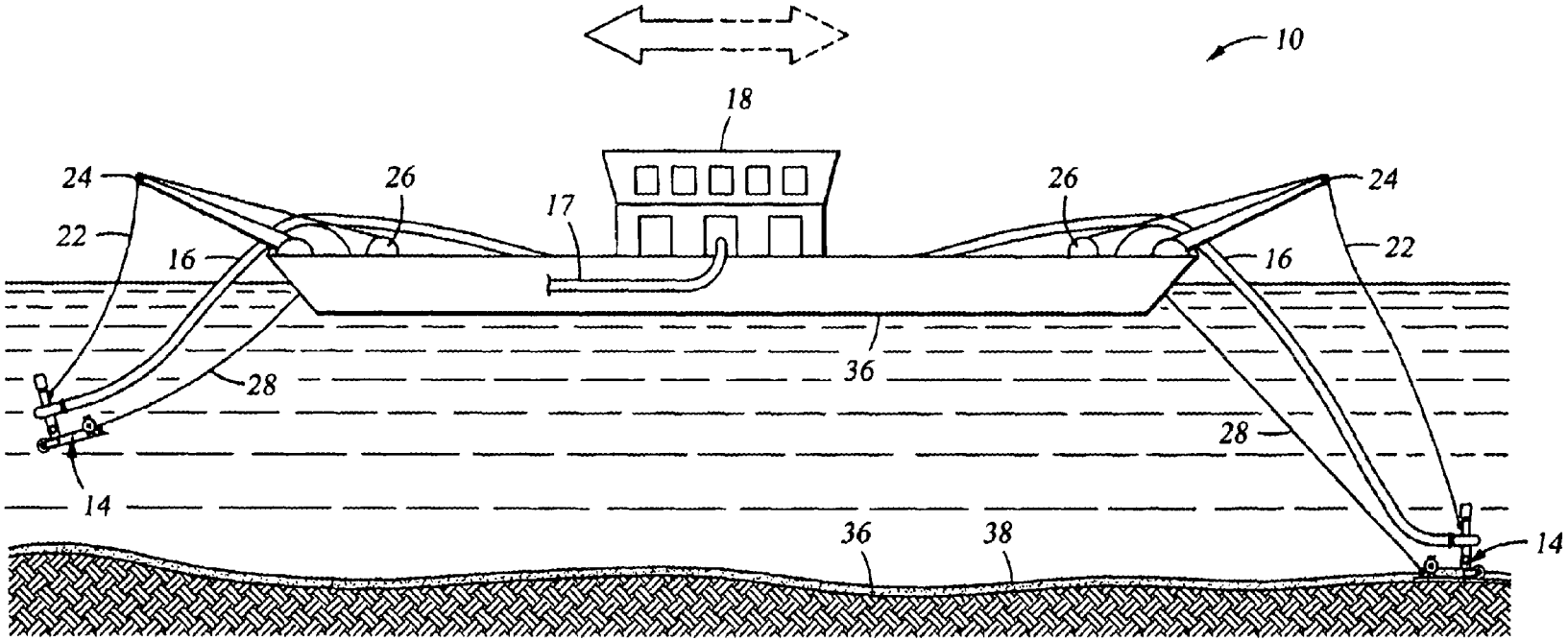
FIG. 2 is a another representative view of the dredging system of the present invention.

As shown in FIG. 1, dredge shoes 14 are movably suspended from booms 24 by first cables 22. As shown in the various Figures, first cables 22 may not be truly vertical but raise and lower shoes 14 in the vertical plane relative to vessel 12. Cables 22 are controlled utilizing a winch 26 (FIG. 2). As will be shown, numerous winches 26, all denoted by the numeral 26, are utilized in operation of system 10.

Shoes 14 are also functionally connected to vessel 12 utilizing a second cable 28. In the disclosed embodiment, second cables 28 maintain shoes 14 in a substantially parallel plane to vessel 12. As shown in FIG. 1, second cables 28 may be connected between a vertically positionable riser 30 and shoes 14. Risers 30 include a vertical section 32 and a horizontal section 34 wherein horizontal section 34 is positioned below vessel 12. Riser 12 is movably connected to vessel 12 in a manner so as to lower or raise horizontal section 34 proximate a bottom 36 (FIG. 2) to be dredged. The moving means for riser 30 are not shown, but may include any number of well known moving apparatus such as hydraulic and electric sources.

With reference to FIG. 1 and FIG. 2, riser 30 and cables 28 may be utilized to aid in maintaining shoes 14 along the bottom 36. However, it may be desired to delete riser 12 and only utilize cable 28, as shown in FIG. 2.

FIG. 2 is a representative view of dredging system 12 of the present invention further demonstrating system 12 in relation to FIG. 1. As shown, one set of dredge shoes 14 are located on the bottom 36 so as to obtain dredge material 38, shown as sand, for beach nourishment or reclamation.

Dredge shoes 14 are operationally connected to power source 18 by conduit 16 and to transport section 17 for transport of dredge material 38 to a deposit site such as a beach. One set of dredge shoes 14, or an individual dredge shoe 14, is suspended to bottom 36 from an end of vessel 12. A second set of dredge shoes 14, or an individual dredge shoe 14, suspended from an opposing end of vessel 12, is maintained above bottom 36. The dredge shoe 14 positioned on bottom 36 trails the movement of vessel 12 as described relative to the following Figures.

As shown in FIGS. 1 and 2, power source 18 includes hydraulic power units for operating dredge shoes 14 and riser 30. However, it should be recognized that power source 18 may include other power sources, singularly or in combination, such as electrical, hydraulic, pneumatic and gas operated sources, for operation of the various elements of dredging system 12.

As shown in the Figures, power source 18 operates shoe 14 and transports dredge material 38 through section 17 to a deposit site. In some applications, and locations, it may be desirable to include a booster pump to transport dredge material 38 to a deposit site. However, dredge system 10 and the method of its operation alleviates the need for booster pumps.

Figure 3:
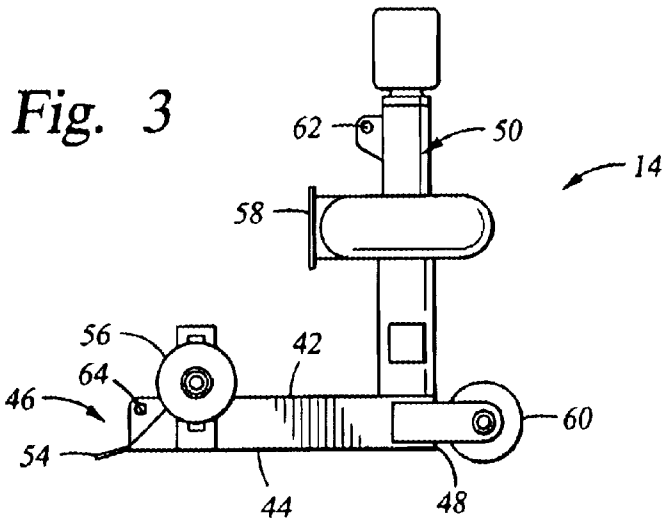
FIG. 3 is a representative, side view of a dredge shoe of the present invention.

FIG. 3 is a representative, side view of a dredge shoe 14 in accordance with one embodiment of the present invention. Dredge shoe 14 includes a sidewall 40 connecting a top wall 42 and a bottom wall 44 forming a dredging inlet 46. Dredging inlet 46 is positioned opposite a closed end 48. A dredge pump 50 is functionally connected through top wall 42 proximate closed end 48.

A tongue 54 extends outward from bottom wall 44 for scooping dredge into shoe 14. A front set of wheels 56 is rotatably attached to shoe 14 proximate dredge inlet 46. Front wheels 56 are positioned on shoe 14 above tongue 54. The position of front wheels 56 may be adjusted as the desired depth of dredged material 38 is determined. For example, with reference, to FIG. 2, it may be desired to take the top six inches of bottom 36 to obtain beach quality sand 38. Front wheels 56 are then set relative to tongue 54 so as to ride on bottom surface 36 to scoop the top six inches of sand 38 through dredge inlet 46 into shoe 14 and transported through conduit 16 to transport conduit section 17. Conduit 16 is connected to dredge pump 50 at connection 58.

Shoe 14 may further include a trailing wheel 60 positioned closed end 48 of shoe 14. Trailing wheel 60 is positioned offset from front wheels 56 and having a bottom surface approximately parallel to tongue 54. In this manner, trail wheel 60 rides on surface 36 after dredging maintaining bottom wall 44 substantially parallel to surface 36 as dredging continues.

FIG. 3 further discloses cable eyelets 62 and 64. With reference to FIGS. 1 and 2 cable 22 is connected to eyelet 62 and cable 28 is connected to eyelet 64.

Figure 4:
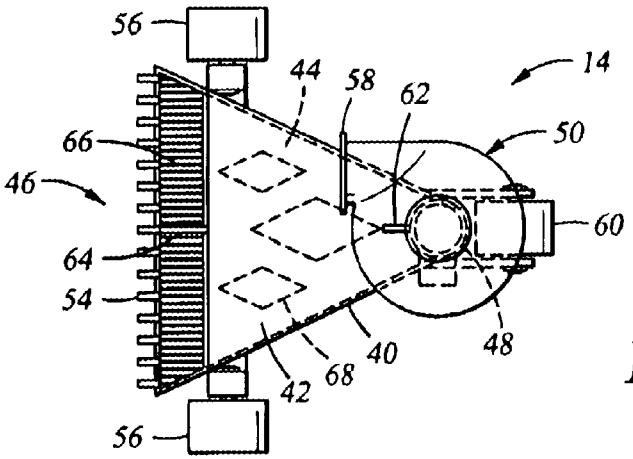
FIG. 4 is a representative, top view of a dredge shoe of the present invention.

FIG. 4 is a representative, top view of dredge shoe 14 of the present invention. As shown, shoe 14 is substantially wedged-shaped, having its broadest section located proximate dredge inlet 46 and its narrowest section proximate closed end 48.

It may be desirable to include a guard 66 attached over dredge inlet 46. Guard 66 may be a mesh or other similar structure to prevent the introduction of oversized material into shoe 14. Guard 66 also protects marine life, such as sea turtles, from being drawn into shoe 14.

Shoe 14 preferably further includes baffles 68 located within shoe 14 between sidewall 40 and top and bottom wall 42 and 44 so as to separate dredged material 38 and importantly, to maintain the velocity of the dredged slurry for transport through conduit 16.

Figure 5:
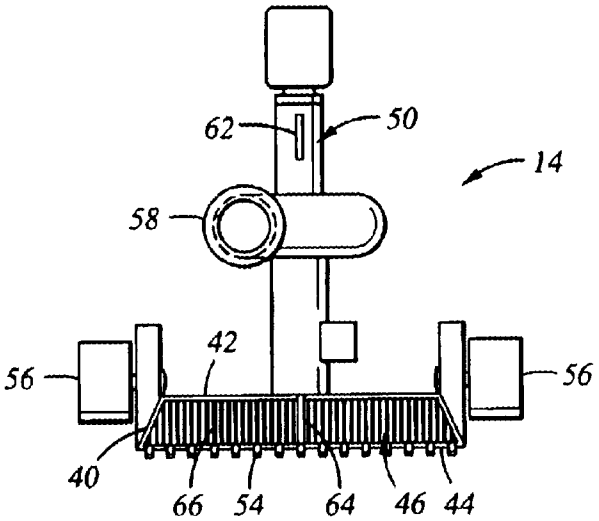
FIG. 5 is a representative, front view of a dredge shoe of the present invention.

FIG. 5 is a representative, front view of shoe 14 of the present invention. With reference to FIGS. 3 through 5 it is apparent that multiple dredge shoes 14 may be connected to one another. Dredge shoes 14 may be connected to one another through numerous known connecting devices to form a rigid dredging line. It may also be desired and preferred to connect adjacent shoes 14 together in a flexible manner utilizing hinges so that each individual shoe 14 more easily follows the profile of bottom 36. It may also be desirable to interconnect adjacent shoes 14 utilizing a spacer bar (not shown) to leave undredged areas within borrow site 70. These devices are not illustrated because, although novel, they are well within the scope of the art to connect multiple shoes 14 together.

Figure 6:
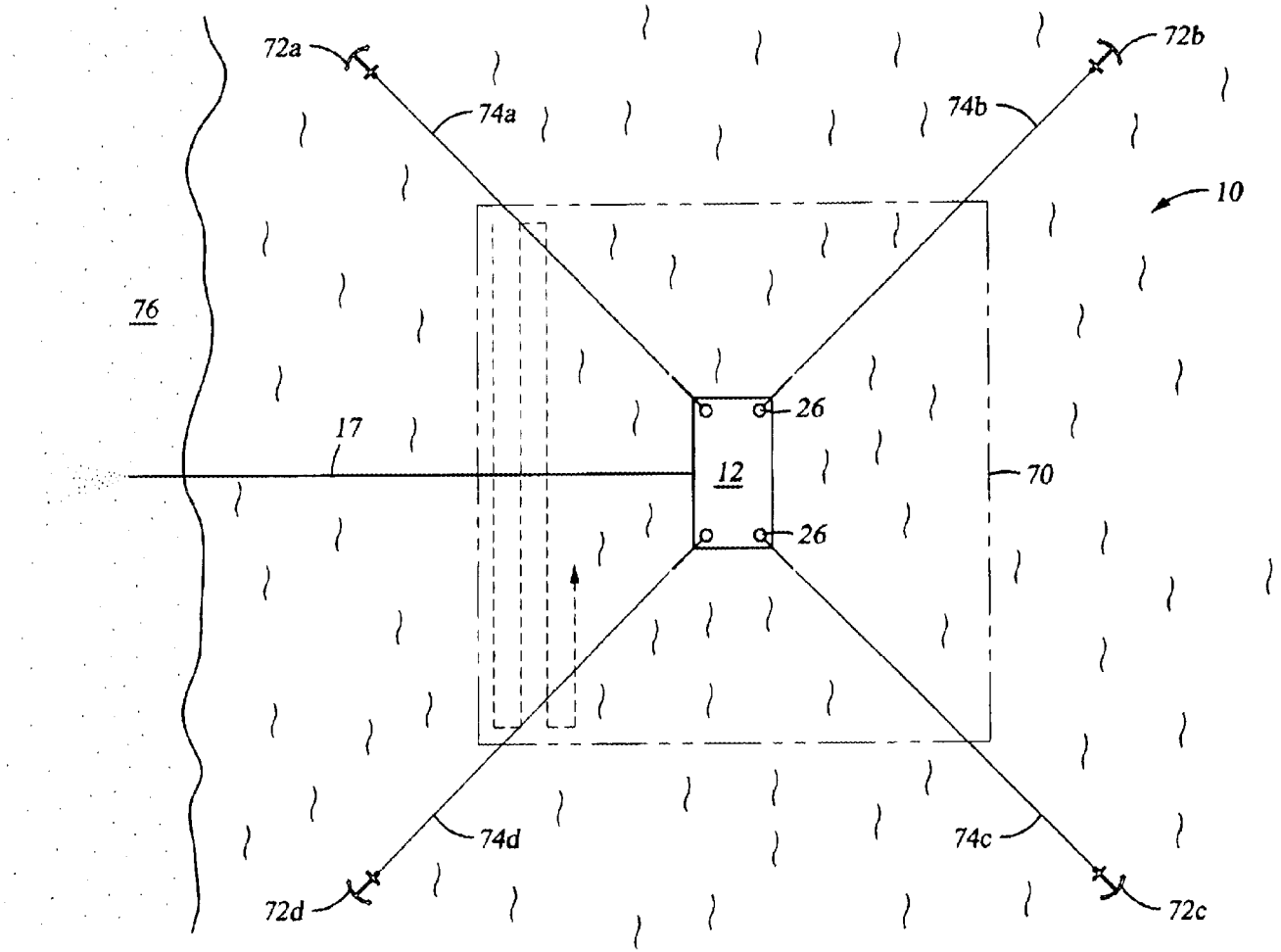
FIG. 6 is a representative view of the dredging system of the illustrating movement of the system over a borrow site.

FIG. 6 is a representative view of dredging system 10 illustrating movement of system 10 over a borrow site. It has been found that beach quality sand 38 is often located proximate deposit sites 76, such as beaches, that are in need of maintenance or remediation. However, these borrow sites often do not have a sufficient quantity or depth of beach quality sand 38 to be utilized with conventional dredging methods. For example, it is often found that beach quality sand 38 is located up to a mile or so from the onshore beach 72. This dredge material 38 is often found in water depths less than 25 feet. However, these deposits of dredge material 38 often only have a thickness of approximately six inches. Therefore, the deposit of quality dredge material 38 is not sufficient for conventional dredging operations.

As shown in FIG. 6, vessel 12 is located atop a borrow site 70. Borrow site 70 is selected for the quality of dredge material 38 and its location to the deposit site 76. Notably, and in accordance with an important aspect of the invention, dredging system 10 and the associated method of dredging allows the selection of sites that have higher quality dredging material that is located closer to a deposit site in spite of the fact that the borrow site may contain a smaller quantity of dredge material then conventionally selected borrow sites.

Once vessel 12 is positioned over borrow site 70, anchors 72 are set in bottom 36 outside of the borrow site 70. Anchors 72 are respectively connected to vessel 12 via cables 74. A winch 26 is operationally connected to each cable 74.

Vessel 12 is stationed and moved back and forth across borrow site 70. In one embodiment, a global positioning system (GPS) in operational contact with winches 26 is employed to coordinate movement of vessel 12. Although not shown in the Figures it is well known to utilize computer hardware, software and/or GPS coordinates in a system to control the movement and placement of an object. As shown in FIG. 6, the motive system moves vessel 12 along a selected path through borrow site 70 pulling shoes 14 along bottom 36, thereby collecting and transporting material 38 to deposit site 72. Through constant monitoring of the location of vessel 12, winches 26 draw in or allow the feeding of cables 74 so as to move vessel 12 and dredge shoes 14 along a paths through borrow site 70.

Figure 7:
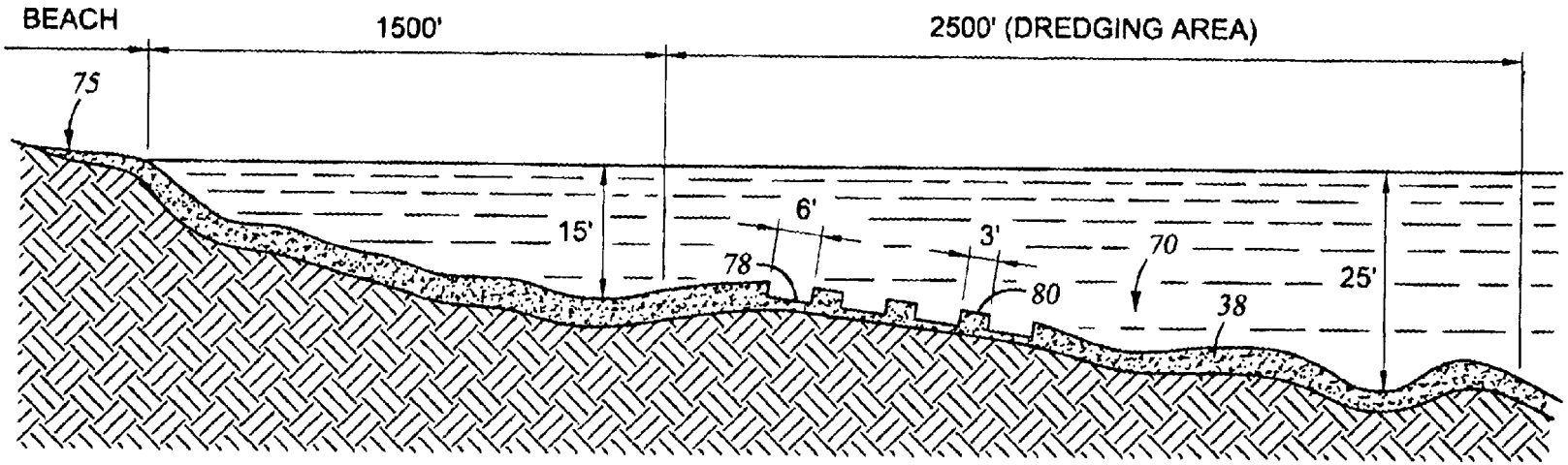
FIG. 7 is a profile view of a dredge site of the present invention.

FIG. 7 is a profile view of a dredge site of the present invention. Borrow site 70 in the exemplary embodiment is located approximately 1500 feet from beach 75 in 15 to 20 feet of water. As shown, one pass of four connected shoes 14 is shown. In this embodiment each shoe is six feet wide and dredges to a depth of six inches. The shoes 14 are interconnected so as to be spaced three feet apart leaving six foot dredge paths 78 separated by three foot ridges 80. These undredged ridges 80 aide in the repopulating of the marine life in borrow side 70.

A method of using the dredging system 10 of the present invention is now described in relation to FIGS. 1 through 7.

A beach 76 is selected for maintenance, nourishment, or reclamation and an operator is contacted to supply sand 38. A borrow site 70 is located proximate beach 76. Typically, with this type of system a borrow site can be located within several thousand of feet of beach 76. It may be desired to map borrow site 70 in a square or similar area to be dredged.

System 10, which is substantially self-contained, is then moved to the site. Vessel 12 is positioned above borrow site 70 and anchors 72 are set outside borrow site 70 to be dredged.

In one embodiment, the combination of winches 26 connected to cables 74 is employed to position vessel 12 proximate a corner of borrow site 70 so as to move vessel 12 along paths substantially parallel to beach 76.

Work boat 20 may be released and transport line 17 is connected or unrolled between vessel 12 and beach 76. Transport conduit 17 may float or be submerged along its path to beach 76. Those of ordinary skill in the relevant art(s) will appreciate that various materials such as dual-lumen conduit may be used for optionally floating or submerging transport line 17.

Dredge shoes 14 are lowered from at least one side of vessel 12 by cables 22 and 28 to bottom 36. Each dredge shoe 14 is connected via conduit 16 to power supply 18 and transport line 17. For the operation, varying numbers of dredge shoes 14 may be utilized depending on the transport requirements. For example, six dredge shoes 14 may be interconnected being spaced three feet apart.

As shown in FIG. 1, system 10 may include risers 30. Risers 30 are lowered proximate bottom 36. In this manner cables 28 and riser 30 aide in controlling movement of shoes 14 relative to vessel 12.

Beach quality sand 38 is typically found along bottom 36 to a depth of approximately six inches. Therefore, it is desirable to set wheels 56 of shoe 14 so that tongue 54 will scoop to a depth of approximately six inches. It should be recognized that various depths of dredging may be selected.

Once dredging shoes 14 are in place and power source 18 is connected and transport line 17 is located for disposal dredging operations can begin. Power supply 18 is initiated and starting dredge pump 50 of shoes 14. As shown in the Figures, a hydraulic system is utilized, however those of ordinary skill in the relevant art(s) will appreciate that other systems may be implemented. Once dredge shoes 18 and pumps 50 are engaged the GPS aided control system is activated, systematically retracting cable 74 connected to at least two anchors 72 and the other cables 26 being let out so that vessel 12 is moved in a line substantially parallel to beach 76. For example, cables 74*a* and 74*c* being retracted while cables 74*b* and 74*d* are let out so that vessel 12 and shoes 14 move toward anchors 72*a* and 72*c*.

As vessel 12 and shoes 14 are moved laterally through borrow site 70, dredge material 38 is scooped by tongue 54 to a selected depth, such as six inches, through inlet 46 into shoe 14. Guard 66 exclude particles over a selected size, for example over 0.75 inches, from entering shoe 14. From shoe 14 dredge pump 50 suctions dredge material 38 and transports it through conduit 16 into transport line 17 and to deposit site 76.

As shown, deposit site 76 may be a beach. Personnel may be positioned at deposit site 76 to spread or deposit material 38. For example, a tractor (not shown) may be connected to the outlet of transport conduit 17 to deposit sand 38 along beach 76 as it is being dredged. Other methods of spreading and/or depositing dredge material 38 may be utilized.

Once vessel 12 and shoes 14 are moved from one side of borrow site 70 to the opposite side of site 70. The first dredge shoes 14 are raised and dredge shoes 14 on the opposite side of vessel 12 are lowered to bottom 36 and the process is continued in the opposite direction on an adjacent path to the previous path.

Dredge system 10 and the method of use provides a novel and unobvious means of dredging a site particularly for beach nourishment, maintenance and repair. The substantially self-contained system allows for quick deployment and performance of an operation significantly reducing the cost of the project over the prior art methods and apparatus. Additionally, the present invention facilitates the dredging of beach quality sand proximate the deposit site that is environmentally friendly.

Although the present invention and its advantages have been described in relation to the illustrated embodiments it should be understood that various changes, substitutions and alterations can be made herein without departing from the spirit and scope of the invention as defined by the appended claims.

What is claimed is:

1. A dredge system for removing material from a borrow site for transport to a deposit site, said dredge system comprising:

a motorized vessel positioned above a borrow site;

at least one dredging shoe extendable from said vessel to a bottom of a water adapted for dredging a material to a pre-selected depth from said bottom;

a power source positioned on said vessel in operational connection with said dredging shoe for drawing said material into said shoe and transporting through a conduit to a deposit site; and a dredging motivation system connected to said vessel for moving in conjunction said vessel and said dredging shoe along a dredging path.

2. The dredge system of claim 1, wherein said dredge shoe is connected to said vessel via a first cable maintaining said shoe in a substantially vertical plane relative to said vessel and a second cable maintaining said shoe in a substantially horizontal plane relative to said vessel.

3. The dredge system of claim 2, wherein said vessel further includes a riser movably connected to said vessel, said riser having a horizontal member moveable to a position proximate said bottom, said second cable being connected to said horizontal member.

4. The dredge system of claim 1, wherein said dredge shoe includes:

a top wall and bottom wall interconnected by a sidewall forming a dredge inlet opposite a closed end;

a dredge pump functionally connected to said shoe through said top wall proximate said closed end; and a front wheel positionally connected to said shoe proximate said dredge inlet and a rear wheel positionally connected proximate said closed end in a manner to position said shoe for dredging a selected depth of said bottom material.

5. The dredge system of claim 4, further including a tongue extending from said bottom wall of said shoe outward from said dredge inlet.

6. The dredge system of claim 2, wherein said dredge shoe includes:

a top wall and bottom wall interconnected by a sidewall forming a dredge inlet opposite a closed end;

a dredge pump functionally connected to said shoe through said top wall proximate said closed end; and a front wheel positionally connected to said shoe proximate said dredge inlet and a rear wheel positionally connected proximate said closed end in a manner to position said shoe for dredging a selected depth of said bottom material.

7. The dredge system of claim 6, further including a tongue extending from said bottom wall of said shoe outward from said dredge inlet.

8. The dredge system of claim 3, wherein said dredge shoe includes:

a top wall and bottom wall interconnected by a sidewall forming a dredge inlet opposite a closed end;

a dredge pump functionally connected to said shoe through said top wall proximate said closed end; and a front wheel positionally connected to said shoe proximate said dredge inlet and a rear wheel positionally connected proximate said closed end in a manner to position said shoe for dredging a selected depth of said bottom material.

9. The dredge system of claim 8, further including a tongue extending from said bottom wall of said shoe outward from said dredge inlet.

10. The dredge system of claim 1, wherein said motivation system includes at least one anchor device extending via a cable from each corner of said vessel, each said cable connected to a winch for retracting and releasing said cables in a manner to move said vessel and said shoe along said dredge path.

11. The dredge system of claim 10, wherein said motivation system further includes a global positioning system in functional control of said winches for moving said vessel and said shoes along said dredge path.

12. The dredge system of claim 2, wherein said motivation system includes at least one anchor device extending via a cable from each corner of said vessel, each said cable connected to a winch for retracting and releasing said cables in a manner to move said vessel and said shoe along said dredge path.

13. The dredge system of claim 12, wherein said motivation system further includes a global positioning system in functional control of said winches for moving said vessel and said shoes along said dredge path.

14. The dredge system of claim 3, wherein said motivation system includes at least one anchor device extending via a cable from each corner of said vessel, each said cable connected to a winch for retracting and releasing said cables in a manner to move said vessel and said shoe along said dredge path.

15. The dredge system of claim 14, wherein said motivation system further includes a global positioning system in functional control of said winches for moving said vessel and said shoes along said dredge path.

16. The dredge system of claim 4, wherein said motivation system includes at least one anchor device extending via a cable from each corner of said vessel, each said cable connected to a winch for retracting and releasing said cables in a manner to move said vessel and said shoe along said dredge path.

17. The dredge system of claim 16, wherein said motivation system further includes a global positioning system in functional control of said winches for moving said vessel and said shoes along said dredge path.

18. A dredge system for removing material from a borrow site for transport to a deposit site, said dredge system comprising:

a motorized vessel positioned above a borrow site;

at least one dredging shoe having a top wall and a bottom wall interconnected by a sidewall forming a dredge inlet opposite a closed end and a dredge pump connected to said shoe through said top wall proximate said closed end, and a front wheel positionally connected to said shoe proximate said dredge inlet and a rear wheel positionally connected proximate said closed end in a manner to position said shoe for dredging a selected depth of a bottom material;

said shoe extendable from said vessel to said bottom via a first cable connected between said shoe and said vessel for maintaining said shoe in a substantially vertical plane relative to said vessel and a second cable maintaining said shoe in a horizontal plane relative to said vessel;

a power source positioned on said vessel in operational connection with said dredging shoe for drawing said material into said shoe and transporting through a conduit to a deposit site; and a dredging motivation system connected to said vessel for moving said vessel and said dredging shoe along a dredging path.

19. The dredge system of claim 18, further including a tongue extending from said bottom wall of said shoe outward from said dredge inlet.

20. The dredge system of claim 18, wherein said motivation system includes at least one anchor device extending via a cable from each corner of said vessel, each said cable connected to a winch for retracting and releasing said cables in a manner to move said vessel and said shoe along said dredge path.

21. The dredge system of claim 20, wherein said motivation system further includes a global positioning system in functional control of said winches for moving said vessel and said shoes along said dredge path.

22. The dredge system of claim 19, wherein said motivation system includes at least one anchor device extending via a cable from each corner of said vessel, each said cable connected to a winch for retracting and releasing said cables in a manner to move said vessel and said shoe along said dredge path.

23. The dredge system of claim 22, wherein said motivation system further includes a global positioning system in functional control of said winches for moving said vessel and said shoes along said dredge path.

24. The dredge system of claim 19, wherein said vessel further includes a riser movably connected to said vessel, said riser having a horizontal member moveable to a position proximate said bottom, said second cable being connected to said horizontal member.

25. The dredge system of claim 20, wherein said vessel further includes a riser movably connected to said vessel, said riser having a horizontal member moveable to a position proximate said bottom, said second cable being connected to said horizontal member.

26. The dredge system of claim 21, wherein said vessel further includes a riser movably connected to said vessel, said riser having a horizontal member moveable to a position proximate said bottom, said second cable being connected to said horizontal member.

27. The dredge system of claim 22, wherein said vessel further includes a riser movably connected to said vessel, said riser having a horizontal member moveable to a position proximate said bottom, said second cable being connected to said horizontal member.

28. The dredge system of claim 23, wherein said vessel further includes a riser movably connected to said vessel, said riser having a horizontal member moveable to a position proximate said bottom, said second cable being connected to said horizontal member.

29. A dredge system for removing material from a borrow site for transport to a deposit site, said dredge system comprising:

a motorized vessel positioned above a borrow site;

at least one dredging shoe having a top wall and a bottom wall interconnected by a sidewall forming a dredge inlet opposite a closed end and a dredge pump connected to said shoe through said top wall proximate said closed end, and a front wheel positionally connected to said shoe proximate said dredge inlet and a rear wheel positionally connected proximate said closed end in a manner to position said shoe for dredging a selected depth of a bottom material;

said shoe extendable from said vessel to said bottom via a first cable connected between said shoe and said vessel for maintaining said shoe in a substantially vertical plane relative to said vessel and a second cable maintaining said shoe in a horizontal plane relative to said vessel;

a power source positioned on said vessel in operational connection with said dredging shoe for drawing said material into said shoe and transporting through a conduit to a deposit site; and a dredging motivation system including at least one anchor device extending via a cable from each corner of said vessel, each said cable connected to a winch for retracting and releasing said cables in a manner to move said vessel and said shoe along said dredge path.

30. The dredge system of claim 29, further including a tongue extending from said bottom wall of said shoe outward from said dredge inlet.

31. The dredge system of claim 29, wherein said motivation system further includes a global positioning system in functional control of said winches for moving said vessel and said shoes along said dredge path.

32. The dredge system of claim 30, wherein said motivation system further includes a global positioning system in functional control of said winches for moving said vessel and said shoes along said dredge path.

33. A dredge system for removing material from a borrow site for transport to a deposit site, said dredge system comprising:

a motorized vessel positioned over a borrow site;

at least one dredging shoe having a top wall and a bottom wall interconnected by a sidewall forming a dredge inlet opposite a closed end and a dredge pump connected to said shoe through said top wall proximate said closed end and a tongue extending from said bottom wall of said shoe outward from said inlet, and a front wheel positionally connected to said shoe proximate said dredge inlet and a rear wheel positionally connected proximate said closed end in a manner to position said shoe for dredging a selected depth of a bottom material.

said shoe extendable from said vessel to said bottom via a first cable connected between said shoe and said vessel for maintaining said shoe in a substantially vertical plane relative to said vessel and a second cable maintaining said shoe in a horizontal plane relative to said vessel;

a power source positioned on said vessel in operational connection with said dredging shoe for drawing said material into said shoe and transporting through a conduit to a deposit site;

a dredging motivation system including at least one anchor device extending via a cable from each corner of said vessel, each said cable connected to a winch for retracting and releasing said cables in a manner to move said vessel and said shoe along said dredge path; and a global positioning system in functional control of said winches for moving said vessel and said shoes along said dredge path.

34. A method of dredging material from a water bottom comprising the steps of: positioning a motorized vessel over a borrow site;

extending at least one dredging shoe from said vessel to a bottom of a water for dredging a material to a pre-selected depth from said bottom;

energizing said dredging shoe for drawing said material into said shoe and transporting through a conduit to a deposit site; and moving said vessel and said dredging shoe along a dredging path.

35. The method of claim 34, wherein said dredge shoe is connected to said vessel via a first cable maintaining said shoe in a substantially vertical plane relative to said vessel and a second cable maintaining said shoe in a substantially horizontal plane relative to said vessel.

36. The method of claim 35, wherein said vessel further includes a riser movably connected to said vessel, said riser having a horizontal member moveable to a position proximate said bottom, said second cable being connected to said horizontal member.

37. The method of claim 34, wherein said dredge shoe includes:

a top wall and bottom wall interconnected by a sidewall forming a dredge inlet opposite a closed end;

a dredge pump functionally connected to said shoe through said top wall proximate said closed end; and a front wheel positionally connected to said shoe proximate said dredge inlet and a rear wheel positionally connected proximate said closed end in a manner to position said shoe for dredging a selected depth of said bottom material.

38. The method of claim 37, further including a tongue extending from said bottom wall of said shoe outward from said dredge inlet.

39. The method of claim 35, wherein said dredge shoe includes:

a top wall and bottom wall interconnected by a sidewall forming a dredge inlet opposite a closed end;

a dredge pump functionally connected to said shoe through said top wall proximate said closed end; and a front wheel positionally connected to said shoe proximate said dredge inlet and a rear wheel positionally connected proximate said closed end in a manner to position said shoe for dredging a selected depth of said bottom material.

40. The method of claim 38, further including a tongue extending from said bottom wall of said shoe outward from said dredge inlet.

41. The method of claim 36, wherein said dredge shoe includes:

a top wall and bottom wall interconnected by a sidewall forming a dredge inlet opposite a closed end;

a dredge pump functionally connected to said shoe through said top wall proximate said closed end; and a front wheel positionally connected to said shoe proximate said dredge inlet and a rear wheel positionally connected proximate said closed end in a manner to position said shoe for dredging a selected depth of said bottom material.

42. The method of claim 41, further including a tongue extending from said bottom wall of said shoe outward from said dredge inlet.

43. The method of claim 34, wherein said vessel and said shoe are moved by at least one anchor device extending via a cable from each corner of said vessel, each said cable connected to a winch for retracting and releasing said cables in a manner to move said vessel and said shoe along said dredge path.

44. The method of claim 43, further including the step of navigating said vessel and said shoe along a dredging path with a global positioning system in functional control of said winches.

45. The method of claim 35, wherein said vessel and said shoe are moved by at least one anchor device extending via a cable from each corner of said vessel, each said cable connected to a winch for retracting and releasing said cables in a manner to move said vessel and said shoe along said dredge path.

46. The method of claim 45, further including the step of navigating said vessel and said shoe along a dredging path with a global positioning system in functional control of said winches.

47. The method of claim 36, wherein said vessel and said shoe are moved by at least one anchor device extending via a cable from each corner of said vessel, each said cable connected to a winch for retracting and releasing said cables in a manner to move said vessel and said shoe along said dredge path.

48. The method of claim 47, further including the step of navigating said vessel and said shoe along a dredging path with a global positioning system in functional control of said winches.

49. The method of claim 37, wherein said vessel and said shoe are moved by at least one anchor device extending via a cable from each corner of said vessel, each said cable connected to a winch for retracting and releasing said cables in a manner to move said vessel and said shoe along said dredge path.

50. The method of claim 49, further including the step of navigating said vessel and said shoe along a dredging path with a global positioning system in functional control of said winches.

51. A method of dredging material from a water bottom comprising the steps of:

positioning a motorized vessel over a borrow site;

extending at least one dredging shoe from said vessel to a bottom of a water, said dredge shoe having a top wall and a bottom wall interconnected by a sidewall forming a dredge inlet opposite a closed end and a dredge pump connected to said shoe through said top wall proximate said closed end, and a front wheel positionally connected to said shoe proximate said dredge inlet and a rear wheel positionally connected proximate said closed end in a manner to position said shoe for dredging a selected depth of a material from said bottom;

energizing said dredging shoe for drawing said material into said shoe and transporting through a conduit to a deposit site; and moving said vessel and said dredging shoe along a dredging path.

52. A method of dredging material from a water bottom comprising the steps of:

positioning a motorized vessel over a borrow site;

extending at least one dredging shoe from said vessel to a bottom of a water, said dredge shoe having a top wall and a bottom wall interconnected by a sidewall forming a dredge inlet opposite a closed end and a dredge pump connected to said shoe through said top wall proximate said closed end, and a front wheel positionally connected to said shoe proximate said dredge inlet and a rear wheel positionally connected proximate said closed end in a manner to position said shoe for dredging a selected depth of a material from said bottom;

energizing said dredging shoe for drawing said material into said shoe and transporting through a conduit to a deposit site; and moving said vessel and said shoe by at least one anchor device extending via a cable from each corner of said vessel, each said cable connected to a winch for retracting and releasing said cables in a manner to move said vessel and said shoe along said dredge path.

53. A method of dredging material from a water bottom comprising the steps of:

positioning a motorized vessel over a borrow site;

extending at least one dredging shoe from said vessel to a bottom of a water, said dredge shoe having a top wall and a bottom wall interconnected by a sidewall forming a dredge inlet opposite a closed end and a tongue extending from said bottom wall of said shoe outward from said inlet, and a dredge pump connected to said shoe through said top wall proximate said closed end, and a front wheel positionally connected to said shoe proximate said dredge inlet and a rear wheel positionally connected proximate said closed end in a manner to position said shoe for dredging a selected depth of a material from said bottom;

energizing said dredging shoe for drawing said material into said shoe and transporting through a conduit to a deposit site;

moving said vessel and said shoe by at least one anchor device extending via a cable from each corner of said vessel, each said cable connected to a winch for retracting and releasing said cables in a manner to move said vessel and said shoe along said dredge path; and navigating said vessel and said shoe along a dredging path with a global positioning system in functional control of said winches.

* * * * *